US007066546B2

(12) United States Patent
Trego et al.

(10) Patent No.: US 7,066,546 B2
(45) Date of Patent: Jun. 27, 2006

(54) HORIZONTALLY ADJUSTABLE CHAIR ARMREST

(75) Inventors: Brian R. Trego, Muscatine, IA (US); Jay R. Machael, Muscatine, IA (US); Marcus C. Koepke, Indianapolis, IN (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/748,537

(22) Filed: Dec. 30, 2003

(65) Prior Publication Data

US 2005/0146192 A1 Jul. 7, 2005

(51) Int. Cl.
*A47C 7/54* (2006.01)

(52) U.S. Cl. ..... 297/411.37; 297/411.36

(58) Field of Classification Search ..... 297/411.36, 297/411.37

See application file for complete search history.

(56) References Cited

U.S. PATENT DOCUMENTS

| | | | | |
|---|---|---|---|---|
| 1,053,117 | A | 2/1913 | Tyden | |
| 2,358,265 | A | 9/1944 | Thomas | |
| 2,549,902 | A | 4/1951 | Hibbard et al. | |
| 4,080,009 | A | 3/1978 | Marathe et al. | |
| 5,215,282 | A | 6/1993 | Bonutti | |
| 5,281,001 | A | 1/1994 | Bergsten et al. | |
| 5,366,297 | A | 11/1994 | Wolverton et al. | |
| 5,374,125 | A | 12/1994 | McMurtry et al. | |
| 5,393,137 | A | 2/1995 | Bivens et al. | |
| 5,415,459 | A | 5/1995 | Schultz | |
| 5,439,267 | A | 8/1995 | Peterson et al. | |
| 5,484,187 | A | 1/1996 | Doerner et al. | |
| 5,641,203 | A | 6/1997 | Van De Riet et al. | |
| 5,660,442 | A | 8/1997 | Tornero | |
| 5,851,054 | A | 12/1998 | Bergsten et al. | |
| 5,853,223 | A | 12/1998 | Ritt et al. | |
| 5,876,097 | A | 3/1999 | Cao | |
| 5,927,811 | A | 7/1999 | Tseng | |
| 5,931,536 | A * | 8/1999 | Wu | 297/411.35 |
| 6,010,193 | A | 1/2000 | Hara et al. | |
| 6,017,091 | A | 1/2000 | Cao | |
| 6,059,366 | A | 5/2000 | Hu | |
| 6,203,109 | B1 | 3/2001 | Bergsten et al. | |
| 6,213,556 | B1 | 4/2001 | Chen | |
| 6,409,266 | B1 | 6/2002 | Chen | |
| 6,572,195 | B1 | 6/2003 | Lee | |

(Continued)

FOREIGN PATENT DOCUMENTS

| | | |
|---|---|---|
| EP | 0958765 | 7/2003 |

*Primary Examiner*—Peter M. Cuomo
*Assistant Examiner*—Joe Edell
(74) *Attorney, Agent, or Firm*—Faegre & Benson, LLP

(57) ABSTRACT

A horizontally adjustable armrest for a chair including a vertically slideable element having a base, a lower horizontal slide element movable longitudinally, an upper horizontal slide element movable laterally and an armrest cover. The lower horizontal slide element includes a longitudinally extending slot with a shoulder. Two fasteners extend through the slot and are fastened to the base. Under the fasteners' heads are springs and washers to bias the lower slide element into frictional engagement with the base. The upper surface of the lower horizontal slide element includes a pair of guide rails which are received in recesses formed in the bottom surface of the upper horizontal slide element. The upper slide element includes two slots extending perpendicular to the slot of the lower slide element. Fasteners, springs and washers are used to bias the upper slide element into frictional engagement with the lower slide element. An armrest cover fits over the horizontal slide elements.

11 Claims, 8 Drawing Sheets

U.S. PATENT DOCUMENTS 6,592,085 B1 7/2003 Iwata et al.
6,773,071 B1 * 8/2004 Stasney et al. ..... 297/411.27
6,802,566 B1 10/2004 Prince
6,974,189 B1 * 12/2005 Machael et al. ..... 297/411.36

* cited by examiner

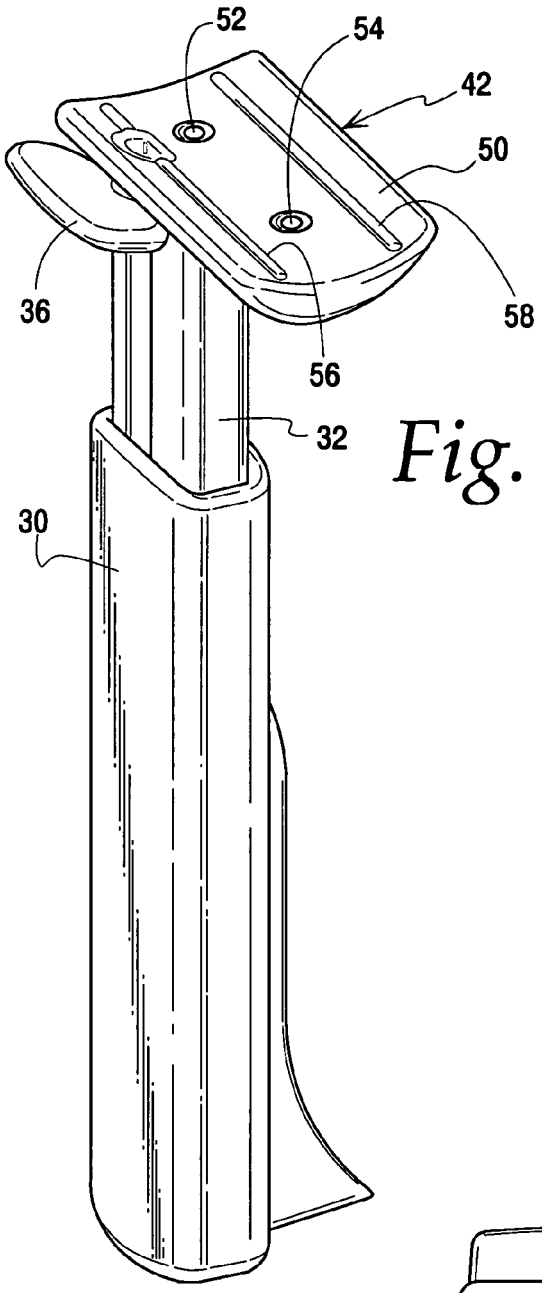
Fig. 6
Fig. 7
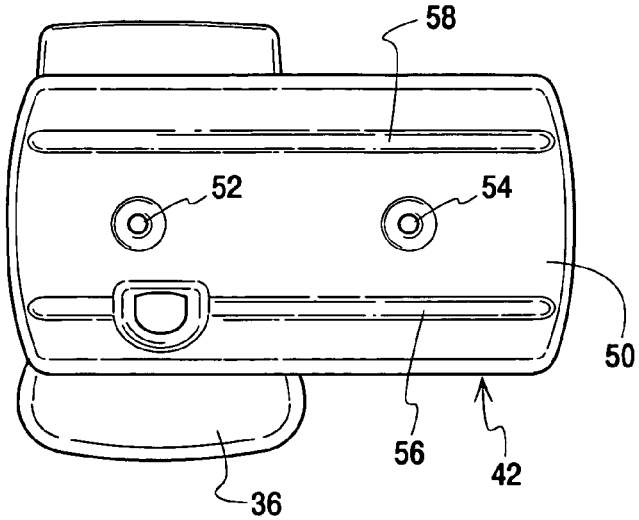

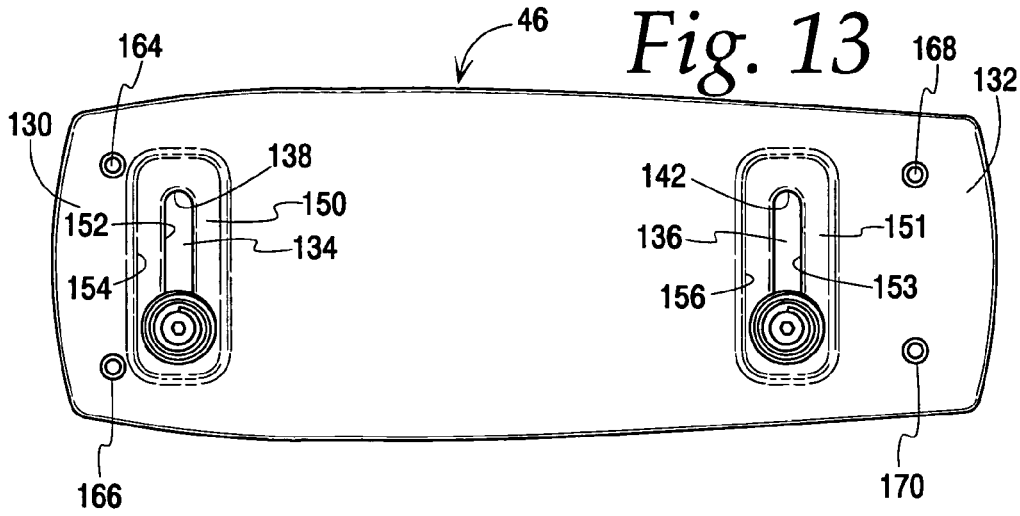
Fig. 13
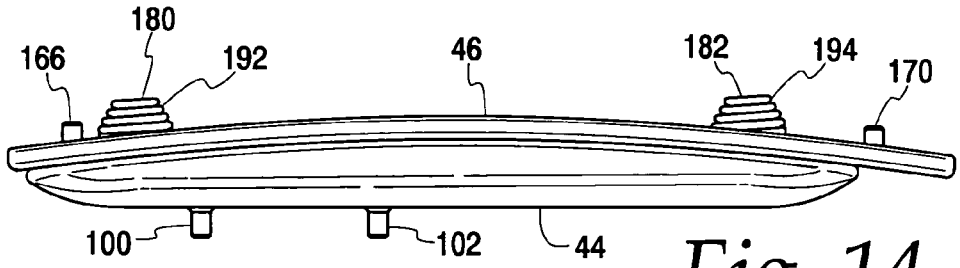
Fig. 14
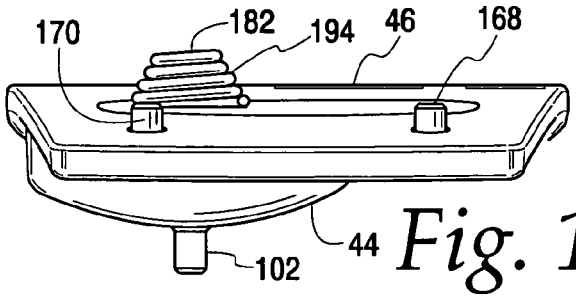
Fig. 15
Fig. 16
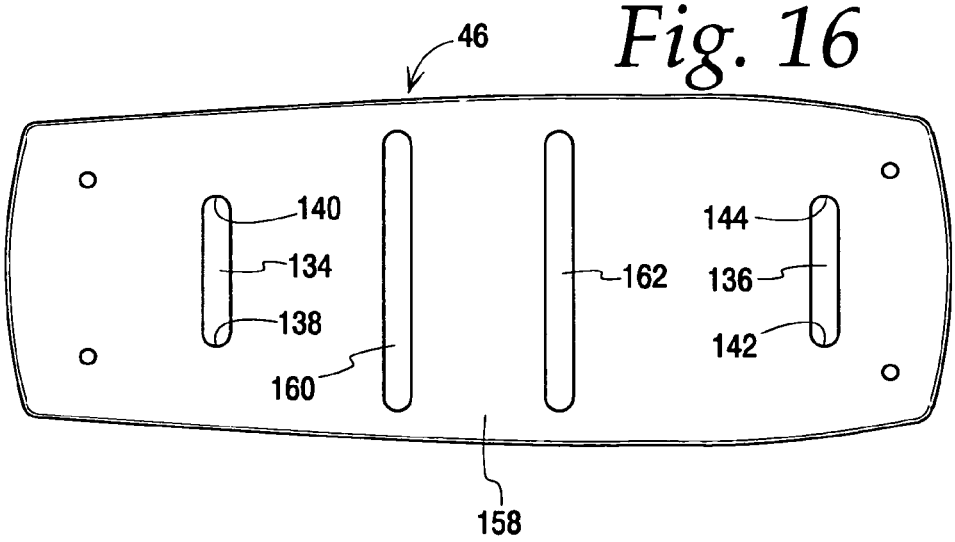

HORIZONTALLY ADJUSTABLE CHAIR ARMREST

CROSS REFERENCE TO PRIORITY APPLICATIONS

Not applicable.

STATEMENT REGARDING FEDERALLY SPONSORED RESEARCH

Not applicable.

BACKGROUND OF THE INVENTION

1. Field of the Invention

The present invention relates to a horizontally adjustable armrest for a chair, and more particularly to a horizontally adjustable armrest for an office chair, the armrest being capable of moving orthogonally and yet still being simply constructed and relatively inexpensive.

2. Description of the Related Art

Adjustable armrests now appear in many office chairs. Some adjust laterally, that is, away from or in toward a chair user. Others move longitudinally, forwardly and backwardly, relative to the chair and the user. Still others swivel in a horizontal plane or tilt about a horizontal axis. In other cases, chairs have armrests that put two or more of the above mentioned movements together.

Examples of horizontally adjustable armrests are shown in U.S. Pat. Nos. 6,592,085; 6,572,195; 6,213,556; 6,059,366; and 6,017,091.

BRIEF SUMMARY OF THE INVENTION

What is described here is a horizontally adjustable armrest for a chair comprising a mounting member connected to the chair, the member having an upper base, first and second slide elements mounted to the base, the slide elements being movable in two directions generally perpendicular to each other, where each slide element has a slot and including fasteners positioned in the slots.

There are a number of advantages, features and objects achieved with the present invention which are believed not to be available in earlier related devices. For example, one advantage is that the present invention provides for a horizontally adjustable chair armrest which is movable in two horizontal directions, the directions being generally perpendicular to each other thereby providing a wide range of adjustability. Other objects of the present invention are that the horizontally adjustable armrest disclosed here is simply constructed and relatively inexpensive. Further advantages of the present invention are that the horizontally adjustable armrest is reliable and robust. Still other features of the horizontally adjustable armrest disclosed here are that the armrest is easily and quickly assembled and is easy to use.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

BRIEF DESCRIPTION OF THE SEVERAL VIEWS OF THE DRAWING

FIG. 6 is an isometric view of a mounting member with an upper base telescopically extending from a support.

FIG. 7 is a top plan view of the upper base.

FIG. 13 is a top plan view of the second slide element.

FIG. 14 is a side elevation view of the second slide element.

FIG. 15 is a front elevation view of the second slide element.

FIG. 16 is a bottom plan view of the second slide element.

DETAILED DESCRIPTION OF A PREFERRED EMBODIMENT OF THE INVENTION

Figure 1:
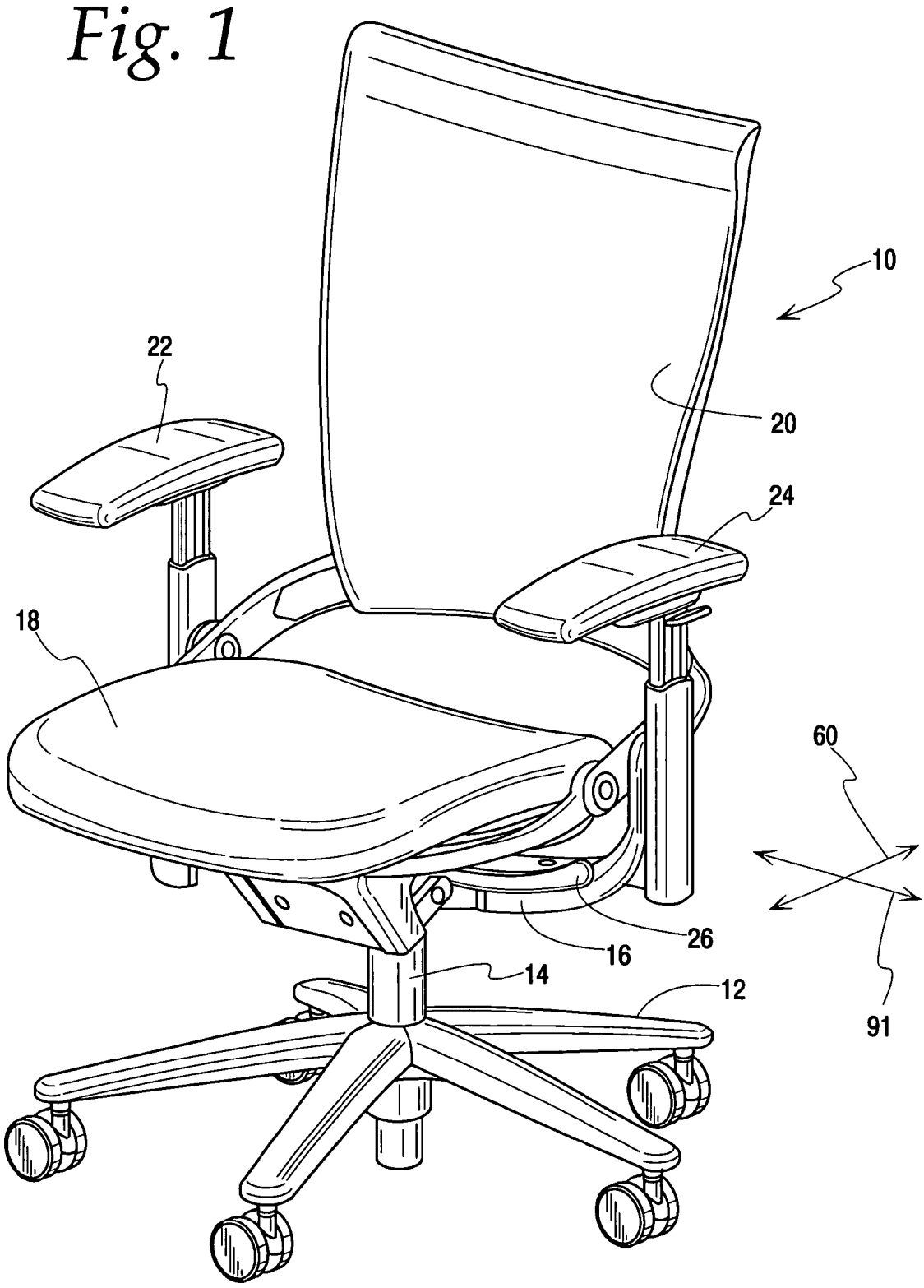
FIG. 1 is an isometric view of an office chair with horizontally adjustable armrests.

While the present invention is open to various modifications and alternative constructions, the preferred embodiment shown in the various figures of the drawing will be described herein in detail. It is understood, however, that there is no intention to limit the invention to the particular embodiment, form or example which is disclosed here. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Referring now to FIG. 1, there is shown an office chair 10 having adjustable armrests. The chair includes a base 12, a pedestal 14, a frame assembly 16, a seat assembly 18, a back assembly 20, a pair of adjustable armrests 22, 24 and control levers, such as a control lever 26.

The simplicity of the adjustable armrests may be appreciated by referring to FIGS. 2, 3, 4 and 5. The armrest 22 includes a support tube 30 connected to the frame assembly 16, a mounting member in the form of a vertical adjustment slide 32, a notched plate 34, an operating rod 36, a lock block 38 and a spring 40. The vertical adjustment slide acts as a mounting member and is formed with an upper base 42. Slidably mounted to the upper base 42 is a first or lower slide element 44. Slidably mounted to the lower slide element 44 is a second or upper slide element 46 and attached to the upper slide element 46 is an armrest cover 48.

Reference is made to co-pending patent applications assigned to the same assignee as the present application and entitled Vertically Adjustable Chair Armrest, application Ser. No. 10/749,010, filed Dec. 30, 2003; Chair with Backward and Forward Passive Tilt Capabilities, application Ser.

No. 10/749,008, filed Dec. 30, 2003; Chair Back, application Ser. No. 10/750,576, filed Dec. 30, 2003; Chair with Adjustable Seat Back, application Ser. No. 10/748,079, filed Dec. 30, 2003; and Tilt Lock Mechanism, application Ser. No. 10/749,009, filed Dec. 30, 2003. These applications disclose other features of the chair. This disclosure here and the disclosure Vertically Adjustable Chair Armrest illustrate the full range of movement of the armrests, both vertically and horizontally. All applications just mentioned are incorporated herein by reference. It is to be appreciated that a chair armrest may be fixed vertically and only adjustable horizontally, or may be fixed horizontally and only adjustable vertically, or the horizontal adjustment assembly disclosed here may be used with a vertical adjustment assembly different from that disclosed in application Ser. No. 10/749,010.

Figure 5:
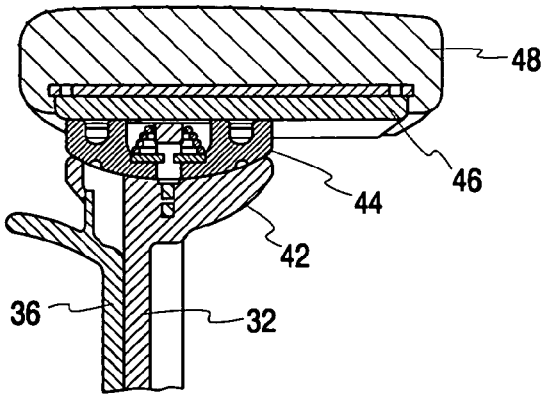
FIG. 5 is a partial, sectional front elevation view of the armrest shown in FIGS. 2–4.

The upper base 42 has an arcuate upper surface 50, FIGS. 5, 6 and 7, and two fastener receiving openings 52, 54. Threaded inserts, not shown, may be molded into the base. Two elongated projections or guide rails 56, 58 are also formed in the upper surface 50, the elongated projections being disposed parallel to a first direction that extends forwardly and rearwardly or longitudinally as symbolized by a double headed arrow 60, FIG. 1.

Figure 9:
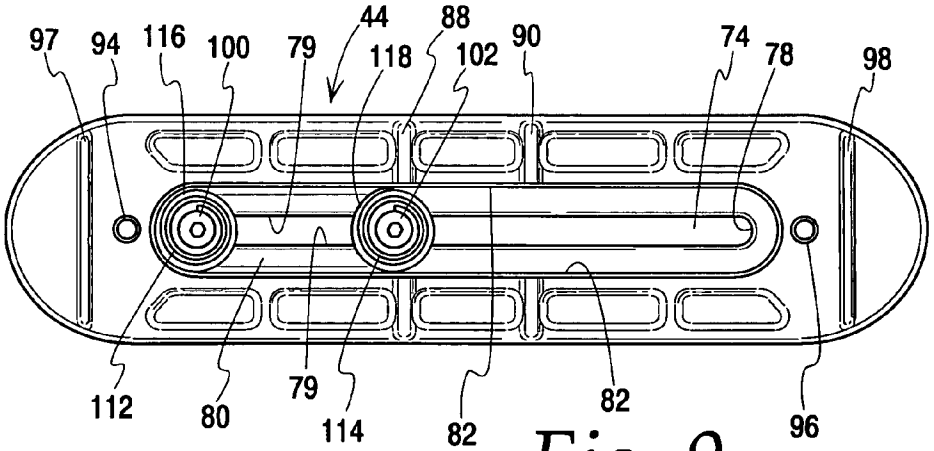
FIG. 9 is a top plan view of the first slide element shown in FIG. 8.
Figure 10:
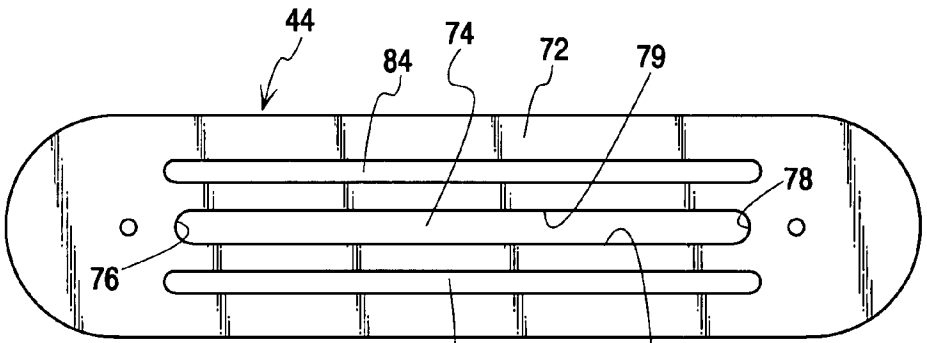
FIG. 10 is a bottom plan view of the first slide element.
Figure 8:
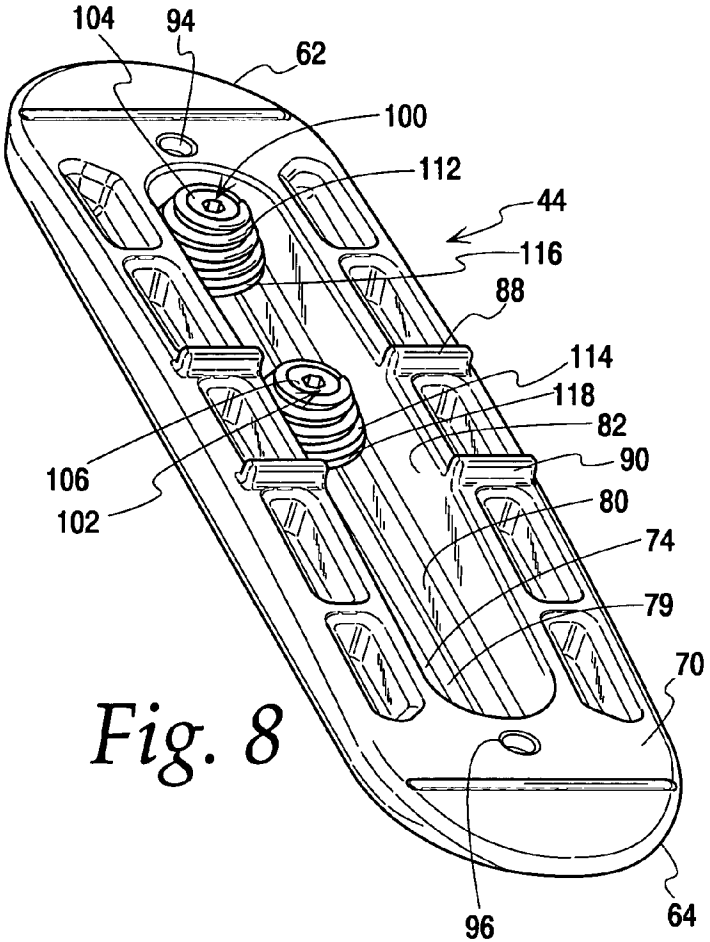
FIG. 8 is an isometric view of a first slide element of the armrest shown in FIGS. 2–7.
Figure 12:
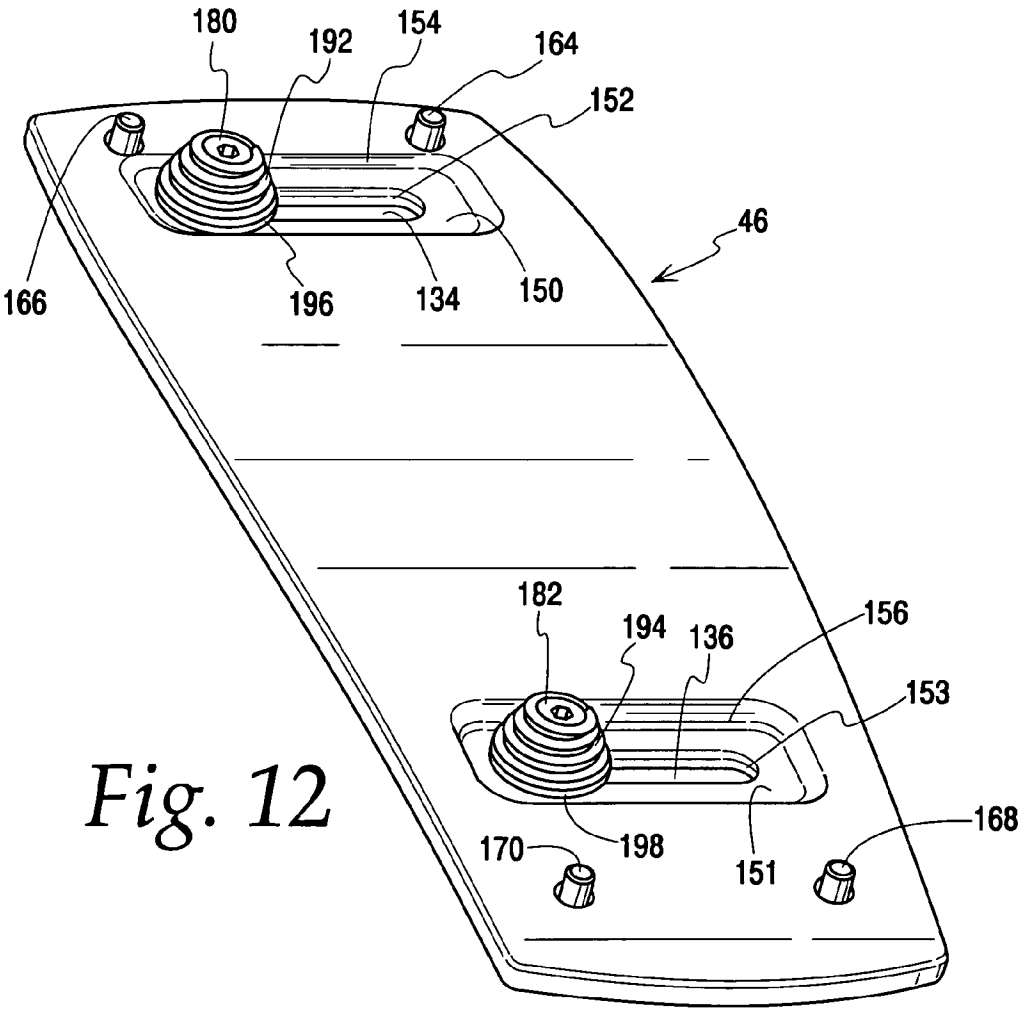
FIG. 12 is an isometric view of a second slide element.

Referring now to FIGS. 8, 9 and 10, the lower slide element 44 is an elongated molded element having rounded end portions 62, 64, an upper surface 70 and a lower surface 72. An elongated mounting slot 74 extending in the longitudinal direction has two end portions 76, 78. Bordering the slot opening is a slot lower wall 79, a shoulder 80 and a slot upper wall 82. The lower surface 72 is arcuate in shape for generally nesting onto the upper surface 50 of the base 42. The lower surface 72 of the lower slide element is generally textured but also includes two parallel smooth runways 84, 86 for moving over the projections 56, 58 of the upper base 42. The upper surface 70 includes two projections or guide rails 88, 90 directed in a second direction which is perpendicular to the first direction. The second direction is symbolized by a double headed arrow 91, FIG. 1. The lower slide element 44 also includes two fastener receiving openings 94, 96 to receive fasteners attaching the upper slide element 46. Two projecting spacers 97, 98 are formed in the upper surface 70, and these engage the upper slide element 46 and compensate for manufacturing tolerances to help provide a consistent sliding force on the upper slide element. The length of the slot 74 helps define the longitudinal adjustment travel of the lower slide element relative to the upper base 42.

A pair of fasteners 100, 102, FIGS. 2–4, 8, 9, 10 and 11, are provided, each having a head 104, 106 and a stem 108, 110. Assembled around the stems are springs 112, 114 and placed beneath the springs are a pair of washers 116, 118. The fasteners are located so that the stems 108, 110 extend through the slot 74 of the lower slide element 44 and are received by and engaged with the fastener receiving opening 52, 54 of the upper base 42. The washers slide along the shoulder 80 and support the springs between them and the heads of the fasteners. Each of the fastener stems includes a shoulder portion 119, 120, FIG. 4, and a thread portion 121, 122. The shoulder portions engage the lower slot wall 79 for guiding the sliding action of the lower slide element 44. Each washer 116, 118 includes a side rim which engages the upper slot wall 82, and also acts to guide the sliding action of the lower slide element 44.

Figure 11:
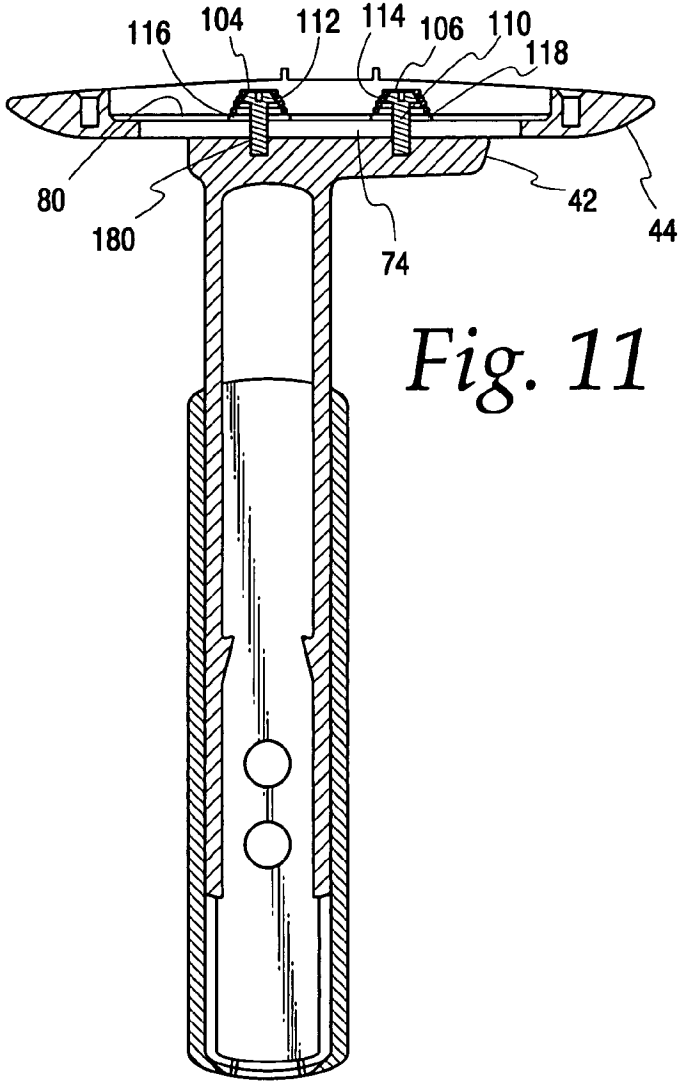
FIG. 11 is a sectional side elevation view of the first slide element mounted to the upper base.

The springs 112, 114 provide a biasing force against the washers 116, 118 which in turn bear against the shoulder 80, FIG. 11 of the slot. This arrangement ensures that the lower slide element 44 is pressed against the upper base 42 with a consistent force to compensate for manufacturing tolerances and provides the force to generate sufficient friction between the lower slide element 44 and the upper base 42 to restrain the location of the lower slide element once a chair user has adjusted the position of the lower slide element. Thus, flexibility is built into the manufacturing process of parts for the chair.

The upper slide element 46, FIGS. 12–16, is in the shape of a longitudinally arcuate panel with curved end portions 130, 132. The upper slide element includes two lateral slots 134, 136 (extending in the second direction) each having closed ends 138, 140 and 142, 144. The upper slide element includes shoulders 150, 151 around the slots, lower slot walls 152, 153 and upper slot walls 154, 156. In a lower surface 158 of the upper slide element, a pair of recesses 160, 162 are formed to receive and engage the guide rails 88, 90 of the lower slide element. Fastener openings 164, 166, 168, 170 are formed in the end portions and are used to receive fasteners to fasten the upper slide element to the armrest cover 48.

Figure 2:
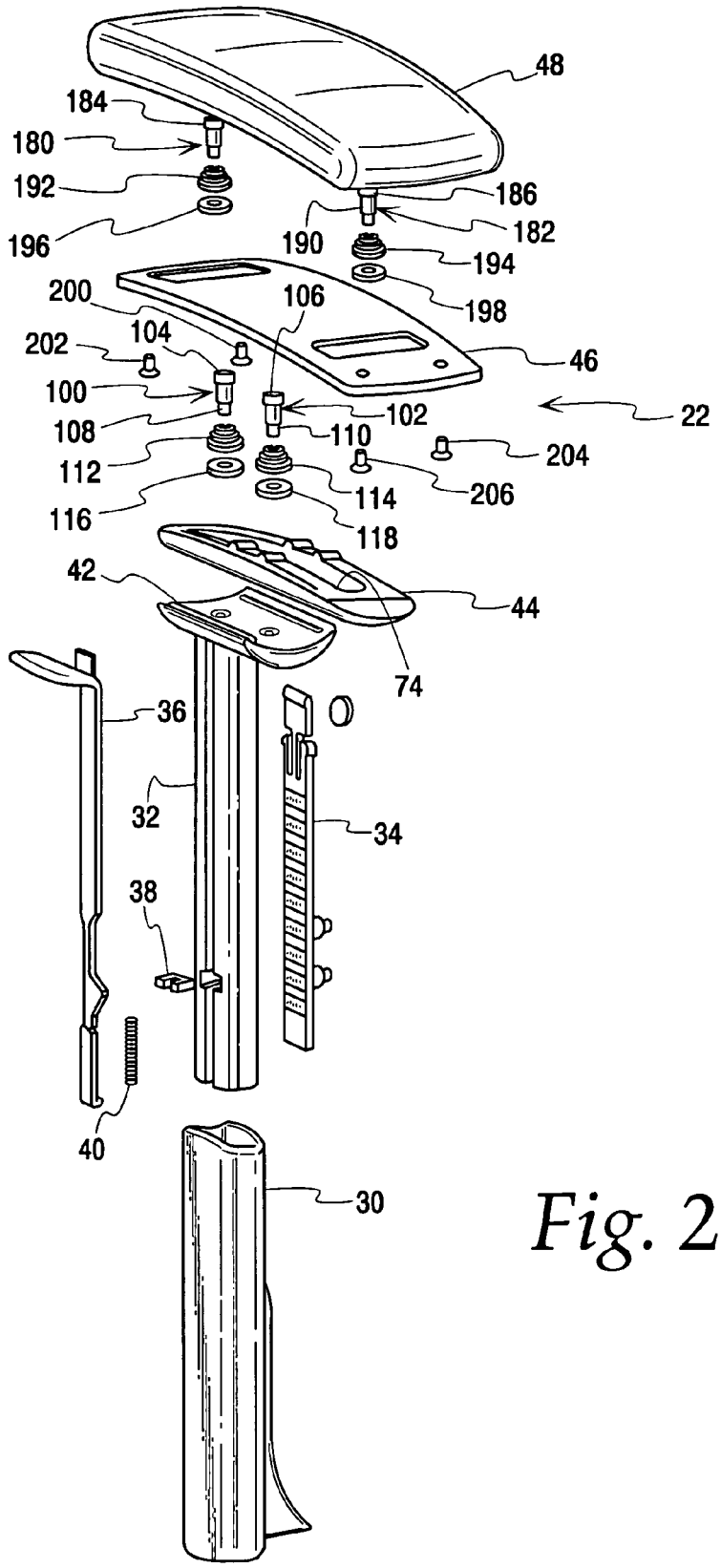
FIG. 2 is an exploded isometric view of one of the horizontally adjustable armrests.

Another pair of fasteners 180, 182, FIGS. 2 and 12–16, are provided, each having a head 184, 186, FIG. 2, and a stem 188, 190. Assemblied around the stems are springs 192, 194 and placed beneath the springs are a pair of washers 196, 198. The fasteners are placed so that the stems extend through the slots 134, 136 of the upper slide element 46 and are received by and engaged with the fastener receiving opening 94, 96 of the lower slide element 44. The washers ride on the shoulders 150, 152 and support the springs between them and the heads of the fasteners. Each washer includes a peripheral rim 154, 156. The recesses 160, 162 guide sliding movement of the upper slide element 48 when the recesses engage the guide rails 88, 90 of the lower slide element 44.

The springs 192, 194 provide a biasing force against the washers which in turn bear against the shoulders 150, 152, and compensate for manufacturing tolerances. This arrangement also ensures that the upper slide element is pressed against the lower slide element with sufficient force to provide a needed friction force to restrain the location of the upper slide element once a chair user has adjusted the position of the upper slide element.

Figure 3:
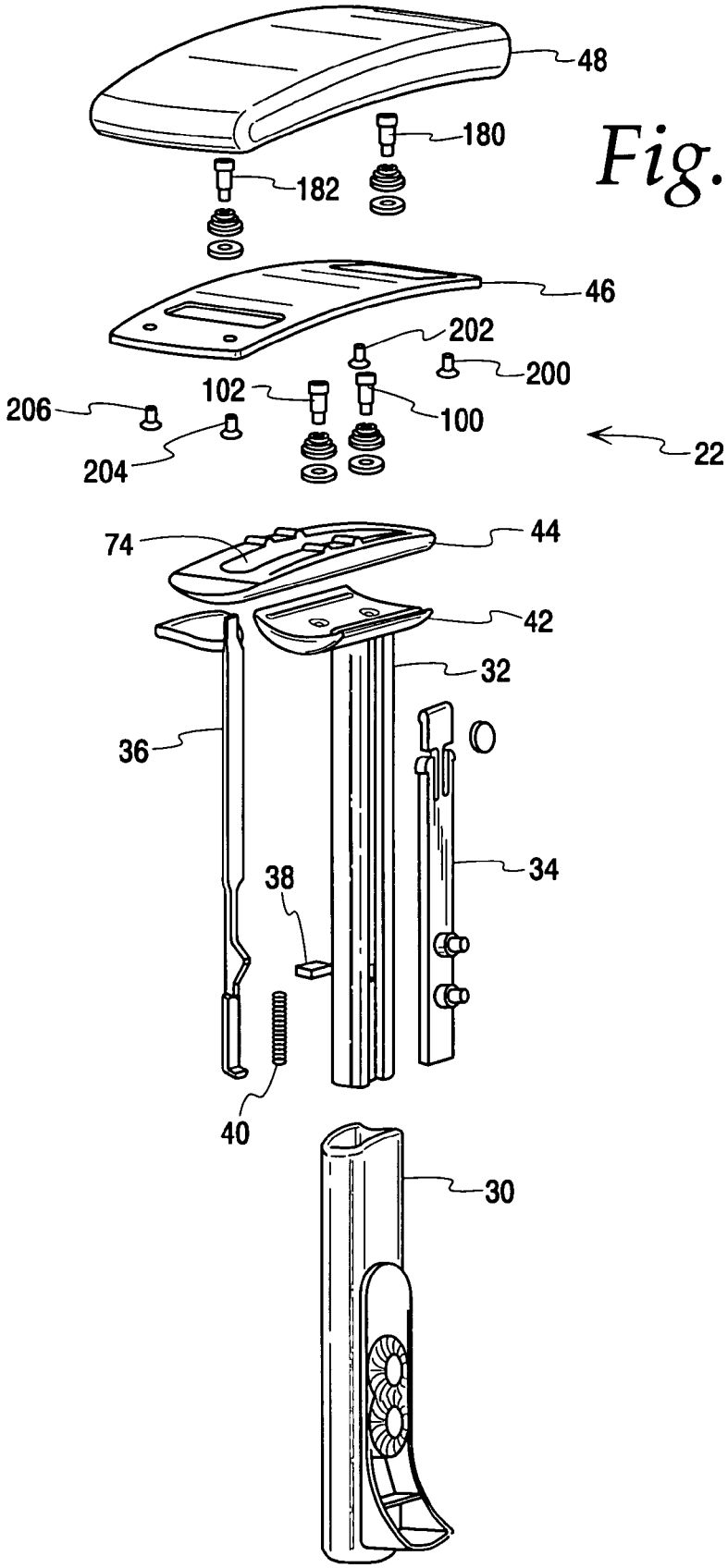
FIG. 3 is another exploded isometric view of the horizontally adjustable armrest rotated about 90 degrees from the view shown in FIG. 2.
Figure 4:
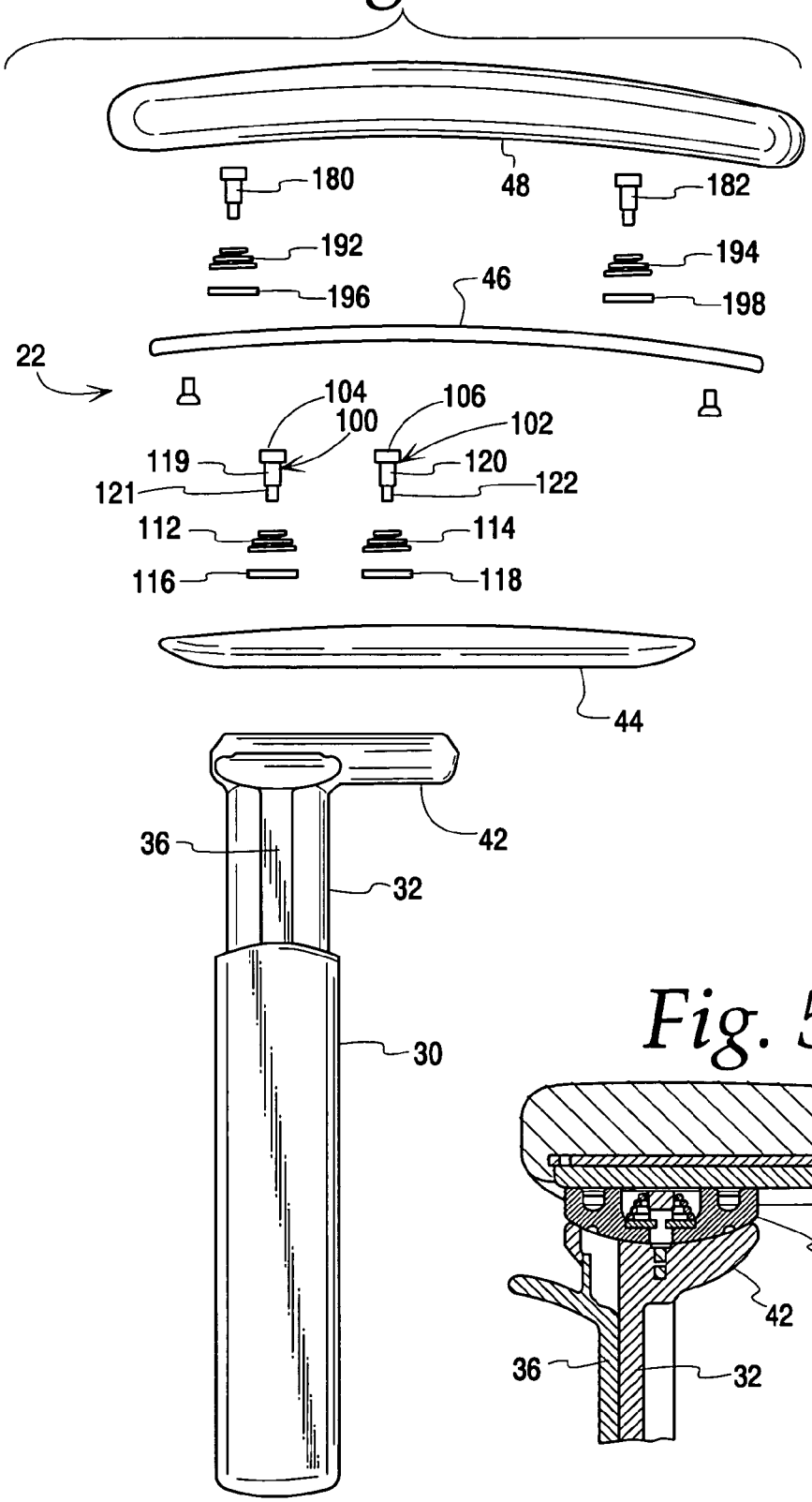
FIG. 4 is an exploded side elevation view of the armrest shown in FIGS. 2 and 3.

A set of four fasteners 200, 202, 204, 206, FIGS. 2 and 3, are provided to be received by the fastener openings 164, 166, 168, 170, FIG. 13, of the upper slide element and engage the cover 48.

The mounting member and upper base, the lower slide element and the upper slide member may be formed of a suitable synthetic resin, such as nylon.

The adjustable armrest is very easy to assemble and allows assembly to be quickly accomplished. The lower slide element 44 is connected to the upper base 42 of the vertical slide 32 using the two fasteners 100, 102. The lateral recesses 160, 162 of the upper slide element are aligned with the guide rails 88, 90 of the lower slide element and the fasteners 180, 182 fit through the slots 134, 136 and are received in the openings 94, 96. The upper slide element 46 is connected to the armrest cover 48 by using the fasteners 200, 202, 204, 206, FIGS. 2 and 3.

In operation, the lower slide element is able to slide longitudinally (first direction) relative to the upper base along the elongated slot 74. In a similar manner, the upper slide element slides laterally (second direction) relative to the lower slide element within the length of the lateral slots.

It can now be appreciated that within the parameters of this orthogonal movement, the armrests of the office chair may be adjusted longitudinally and laterally to any position within the limits of movement. Moreover, this is done with a simply constructed, relatively inexpensive structure which structure is reliable and robust.

The above specification describes in detail a preferred embodiment of the present invention. Other examples, embodiments, modifications and variations will, under both the literal claim language and the doctrine of equivalents, come within the scope of the invention defined by the appended claims. For example, altering the shapes of the lower slide element, the upper slide element, the upper base or the armrest cover will still be considered equivalent structures and will also come within the literal language of the claims. The same is true of the fasteners, the springs and the washers. Still other alternatives will also be equivalent as will many new technologies. There is no desire or intention here to limit in any way the application of the doctrine of equivalents nor to limit or restrict the scope of the invention.

The invention claimed is:

1. A horizontally adjustable armrest assembly for a chair comprising:

a mounting member connected to said chair, said mounting member having an upper base;

a first horizontal slide element slidably mounted to said upper base, said first slide element being adjustably slidable in a first direction with respect to said upper base, and said first slide element being restrained after adjustment with respect to said upper base by frictional engagement between said upper base and said first slide element;

a second horizontal slide element for slidably mounting to said first slide element and slidable in a second direction substantially perpendicular to said first direction, said second slide element restrained after adjustment with respect to said first slide element by frictional engagement between said second slide element and said first slide element;

said first slide element including a slot formed therein directed along said first direction;

said upper base including a fastener receiving opening therein and including a fastener received in said slot of said first slide element and in said fastener receiving opening of said upper base for adjustably mounting said first slide element to said upper base;

a guide for directing sliding movement of said first slide element with respect to said upper base;

said guide mounted to said fastener and engaging walls of said slot of said first slide element;

said fastener comprising a stem and a head; and said guide comprising a washer through which said stem of said fastener extends, a side rim of said washer engaging said walls of said slot.

2. The adjustable armrest of claim 1, further comprising:

a biasing element disposed between said head of said fastener and said washer.

3. A horizontally adjustable armrest assembly for a chair comprising:

a mounting member connected to said chair, said mounting member having an upper base:

a first horizontal slide element slidably mounted to said upper base, said first slide element being slidable in a first direction with respect to said upper base, said first slide element maintaining after adjustment a substantially fixed position with respect to said upper base by frictional engagement;

a second slide element slidably mounted to said first slide element in a second direction substantially perpendicular to said first direction;

said first slide element including a slot formed therein directed along said first direction;

said upper base comprising two fastener receiving openings therein and including two fasteners received in said slot of said first slide element and in said fastener receiving openings for adjustably mounting said first slide element to said upper base;

a guide for directing sliding movement of said first slide element with respect to said upper base;

said guide mounted to said fastener and engaging walls of said slot of said first slide element; and said fastener comprising a stem and a head and said guide comprising a washer through which said stem of said fastener extends, a side rim of washer engaging the walls of said slot.

4. The adjustable armrest of claim 3, further comprising:

a biasing element disposed between said head of said fastener and said washer.

5. A horizontally adjustable armrest assembly for a chair comprising:

a mounting member connected to said chair, said mounting member having an upper base;

a first slide element mounted to said upper base, said first slide element being adjustably slidable in a first direction with respect to said upper base, and said first slide element being frictionally engaged to said upper base;

a second slide element mounted to said first slide element and being adjustably slidable in a second direction generally perpendicular to said first direction, said second slide element being frictionally engaged to said first slide element;

said first slide element including an elongated slot formed therein parallel to said first direction;

said upper base including a fastener receiving opening therein and including a fastener received in said slot of said first slide element and in said fastener receiving opening of said upper base for frictionally engaging said first slide element to said upper base; and a guide structure for directing sliding movement of said first slide element with respect to said upper base; said guide structure to engage walls around said slot of said first slide element.

6. The adjustable armrest of claim 5 wherein:

said fastener comprises a stem portion and a head portion, said guide structure comprises a washer through which said stem of said fastener extends, and said washer has a peripheral rim.

7. The adjustable armrest of claim 6, further comprising:

a biasing element disposed between said head of said fastener and said washer.

8. A horizontally adjustable armrest assembly for a chair comprising:

a mounting member adapted to be connected to the chair, the mounting member having an upper base, said upper base including first and second guide rails extending in a first direction, and first and second spaced apart fastener receiving openings;

a first elongated slide structure mounted to said upper base and extending in the first direction, said first slide structure including a first elongated slot aligning with said first and second fastener receiving openings of said upper base and extending to a distance greater than the distance between said first and said second fastener receiving openings of said upper base, a lower surface for engaging said first and said second guide rails of said upper base, and an upper surface having first and second guide rails extending in a second direction generally perpendicular to the first direction, and third and fourth spaced apart fastener receiving openings;

a second elongated slide structure mounted to said first slide structure and extending in the first direction, said second slide structure including second and third elongated slots, said second slot being aligned with said first fastener receiving opening of said upper surface of said first slide structure and said third slot being aligned with said second fastener receiving opening of said upper surface of said first slide structure, said second and third slots extending in a second direction perpendicular to the first direction, and a lower surface having first and second elongated recesses for engaging said first and second guide rails of said upper surface of said first slide structure;

first and second fasteners positioned in said first slot of said first slide structure and in said first and second fastener receiving openings of said upper base;

first and second springs, said first spring being mounted around said first fastener and said second spring being mounted around said second fastener, said first and second springs to bias said first slide structure against said upper base;

third and fourth fasteners, said third fastener being positioned in said second slot of said second slide structure and in said third fastener receiving opening of said first slide structure and said fourth fastener being positioned in said third slot of said second slide structure and in said fourth fastener receiving opening of said first slide structure; and third and fourth springs, said third spring being mounted around said third fastener and said fourth spring being mounted around said fourth fastener, said third and fourth springs to bias said second slide structure against said first slide structure.

9. The armrest of claim 8 wherein:

each of said first, second and third slots is surrounded by a shoulder.

10. The armrest of claim 9 including:

first, second, third and fourth washers wherein each washer is movable along a respective shoulder, said first washer being mounted around said first fastener, said second washer being mounted around said second fastener, said third washer being mounted around said third fastener, and said fourth washer being mounted around said fourth fastener.

11. The armrest of claim 10 including:

first and second spaced apart spacer projections formed on said upper surface of said first slide structure, said spacer projections being spaced from said first and second guide rails of said upper surface of said first slide structure.

* * * * *